US011419779B2

(12) United States Patent
Lee et al.

(10) Patent No.: US 11,419,779 B2
(45) Date of Patent: Aug. 23, 2022

(54) SITTING TYPE SPINAL TRACTION AND DISC MASSAGE APPARATUS

(71) Applicants: Asia University, Taichung (TW); Bor-Tsang Wu, Taichung (TW)

(72) Inventors: Shin-Da Lee, Taichung (TW); Bor-Tsang Wu, Taichung (TW)

(73) Assignees: Bor-Tsang Wu, Taichung (TW); Asia University, Taichung (TW)

( * ) Notice: Subject to any disclaimer, the term of this patent is extended or adjusted under 35 U.S.C. 154(b) by 212 days.

(21) Appl. No.: 16/807,391

(22) Filed: Mar. 3, 2020

(65) Prior Publication Data

US 2020/0281794 A1 Sep. 10, 2020

(30) Foreign Application Priority Data

Mar. 4, 2019 (CN) ..... 201910161085.4

(51) Int. Cl.
*A61H 1/02* (2006.01)
*A61H 1/00* (2006.01)
(Continued)

(52) U.S. Cl.
CPC ..... *A61H 1/0218* (2013.01); *A61H 1/005* (2013.01); *A61H 1/0222* (2013.01);
(Continued)

(58) Field of Classification Search
CPC .... A61H 1/005; A61H 1/0218; A61H 1/0222; A61H 1/0292; A61H 23/02;
(Continued)

(56) References Cited

U.S. PATENT DOCUMENTS 1,356,365 A * 10/1920 Hosmer ..... A61H 1/0218 602/32
4,649,905 A * 3/1987 Barnes ..... A61G 13/009 606/245
(Continued)

FOREIGN PATENT DOCUMENTS

CN 201179131 Y 1/2009
CN 102028572 A 4/2011
(Continued)

OTHER PUBLICATIONS

Search Report appended to an Office Action, which was issued to Chinese counterpart application No. 201910161085.4 by the CNIPA dated Oct. 12, 2020, with an English translation thereof.
(Continued)

*Primary Examiner* — Tu A Vo
*Assistant Examiner* — Alexander Morales
(74) *Attorney, Agent, or Firm* — Brooks Kushman P.C.

(57) ABSTRACT

A sitting type spinal traction and disc massage apparatus includes a seat member, a seat pad disposed atop the seat member, a fixing member straddling the seat member and the seat pad and connected to the seat member to fix hips of a user to the seat member, and a moving backrest board disposed atop a rear end of the seat member. The moving backrest board is movable relative to the seat member. A restricting member straddles and is connected to the moving backrest board to fix the user's upper body to the moving backrest board. A lifting unit is disposed below the moving backrest board to move the moving backrest board upwardly from the seat member to stretch the user's spine. A vibrating unit is disposed within and vibrates the seat pad.

8 Claims, 9 Drawing Sheets

(51) Int. Cl.

| | |
|---|---|
| ***A63B 21/02*** | (2006.01) |
| ***A63B 21/00*** | (2006.01) |
| ***A63B 23/02*** | (2006.01) |
| ***A61H 23/02*** | (2006.01) |
| ***A63B 23/00*** | (2006.01) |

(52) U.S. Cl.

CPC ..... *A61H 1/0292* (2013.01); *A61H 23/02* (2013.01); *A61H 23/0254* (2013.01); *A63B 21/025* (2013.01); *A63B 21/4009* (2015.10); *A63B 23/0238* (2013.01); *A61H 2001/0203* (2013.01); *A61H 2001/0207* (2013.01); *A61H 2201/0149* (2013.01); *A61H 2201/0192* (2013.01); *A61H 2201/0207* (2013.01); *A61H 2201/1246* (2013.01); *A61H 2201/163* (2013.01); *A61H 2201/1623* (2013.01); *A61H 2201/1626* (2013.01); *A61H 2201/1633* (2013.01); *A61H 2201/1666* (2013.01); *A61H 2201/1673* (2013.01); *A61H 2203/0431* (2013.01); *A61H 2205/081* (2013.01); *A63B 2023/003* (2013.01); *A63B 2023/006* (2013.01); *A63B 2208/0233* (2013.01); *A63B 2210/02* (2013.01)

(58) Field of Classification Search

CPC ..... A61H 23/0254; A61H 2001/0203; A61H 2001/0207; A61H 2201/0149; A61H 2201/0192; A61H 2201/0207; A61H 2201/1246; A61H 2201/1623; A61H 2201/1626; A61H 2201/163; A61H 2201/1633; A61H 2201/1666; A61H 2201/1673; A61H 2203/0431; A61H 2205/081; A63B 21/025; A63B 21/4009; A63B 23/0238; A63B 2023/003; A63B 2023/006; A63B 2208/0233; A63B 2210/02; A63B 21/0442; A47C 7/402; A47C 7/44; A47C 7/443

USPC ..... 602/32, 36, 39, 40; 297/296, 297, 298, 297/301.1, 301.6, 301.7

See application file for complete search history.

(56) References Cited

U.S. PATENT DOCUMENTS

| | | | | |
|---|---|---|---|---|
| 6,626,494 | B2 * | 9/2003 | Yoo | A47C 7/46 297/284.4 |
| 6,918,884 | B2 * | 7/2005 | Knelsen | B60N 2/66 297/284.4 |
| 7,097,628 | B1 * | 8/2006 | Baune | A61F 5/3769 297/464 |
| 7,967,379 | B2 * | 6/2011 | Walters | B60N 2/818 297/284.3 |
| 8,998,321 | B2 * | 4/2015 | Piretti | A47C 7/443 297/299 |
| 9,427,371 | B1 * | 8/2016 | Lamar | A47C 1/032 |
| 2006/0161203 | A1 | 7/2006 | Endara et al. | |
| 2006/0224097 | A1 | 10/2006 | Bass | |
| 2017/0196371 | A1 | 7/2017 | Liu | |
| 2019/0358112 | A1 * | 11/2019 | Grens | A61H 23/02 |

FOREIGN PATENT DOCUMENTS

| | | | |
|---|---|---|---|
| CN | 205094735 | U | 3/2016 |
| CN | 108042251 | A | 5/2018 |
| CN | 108606520 | A | 10/2018 |
| JP | H06233791 | A | 8/1994 |

OTHER PUBLICATIONS

Search Report appended to an Office Action, which was issued to Taiwanese counterpart application No. 109101219 by the TIPO dated Jun. 12, 2020, with an English translation thereof.

Search Report appended to an Office Action, which was issued to European counterpart application No. 20160371.9 by the EPO dated Jun. 7, 2020.

* cited by examiner

SITTING TYPE SPINAL TRACTION AND DISC MASSAGE APPARATUS

CROSS-REFERENCE TO RELATED APPLICATION

This application claims priority to Chinese Patent Application No. 201910161085.4, filed on Mar. 4, 2019.

FIELD

The disclosure relates to a rehabilitation apparatus, and more particularly to a sitting type spinal traction and disc massage apparatus.

BACKGROUND

For patients suffering from lumbar spine pains due to bone spurs or herniated discs, one of therapy methods is to stretch spine by using a bed traction device for restoration of intervertebral discs and pain relief. However, the bed traction device is relatively large in volume and requires complicated operating procedure. The bed traction device not only occupies a relatively large space in a hospital or a clinic, but also is inappropriate for a user to buy and use it at home. In addition, the bed traction device lacks a lumbar massage function while stretching the user's spine.

SUMMARY

Therefore, an object of the disclosure is to provide a sitting type spinal traction and disc massage apparatus that is relatively small in size and that is capable of massaging intervertebral discs while stretching lower lumbar spine.

According to the disclosure, a sitting type spinal traction and disc massage apparatus includes a chair unit, a traction unit, a lifting unit and a vibrating unit.

The chair unit includes a leg assembly, a seat member disposed atop the leg assembly, a seat pad disposed atop the seat member, and a fixing member straddling the seat member and the seat pad and connected to left and right sides of the seat member. The fixing member is configured to fix hips of a user to the seat member.

The traction unit is connected to the chair unit and includes a moving backrest board disposed atop a rear end of the seat member and movable upwardly and downwardly relative to the seat member, and a restricting member straddling the moving backrest board and connected to lift and right sides of the moving backrest board. The restricting member is configured to fix the user's upper body to the moving backrest board.

The lifting unit is disposed below the moving backrest board to move the moving backrest board (23) upwardly from the seat member to stretch the user's spine.

The vibrating unit is disposed within and vibrates the seat pad.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
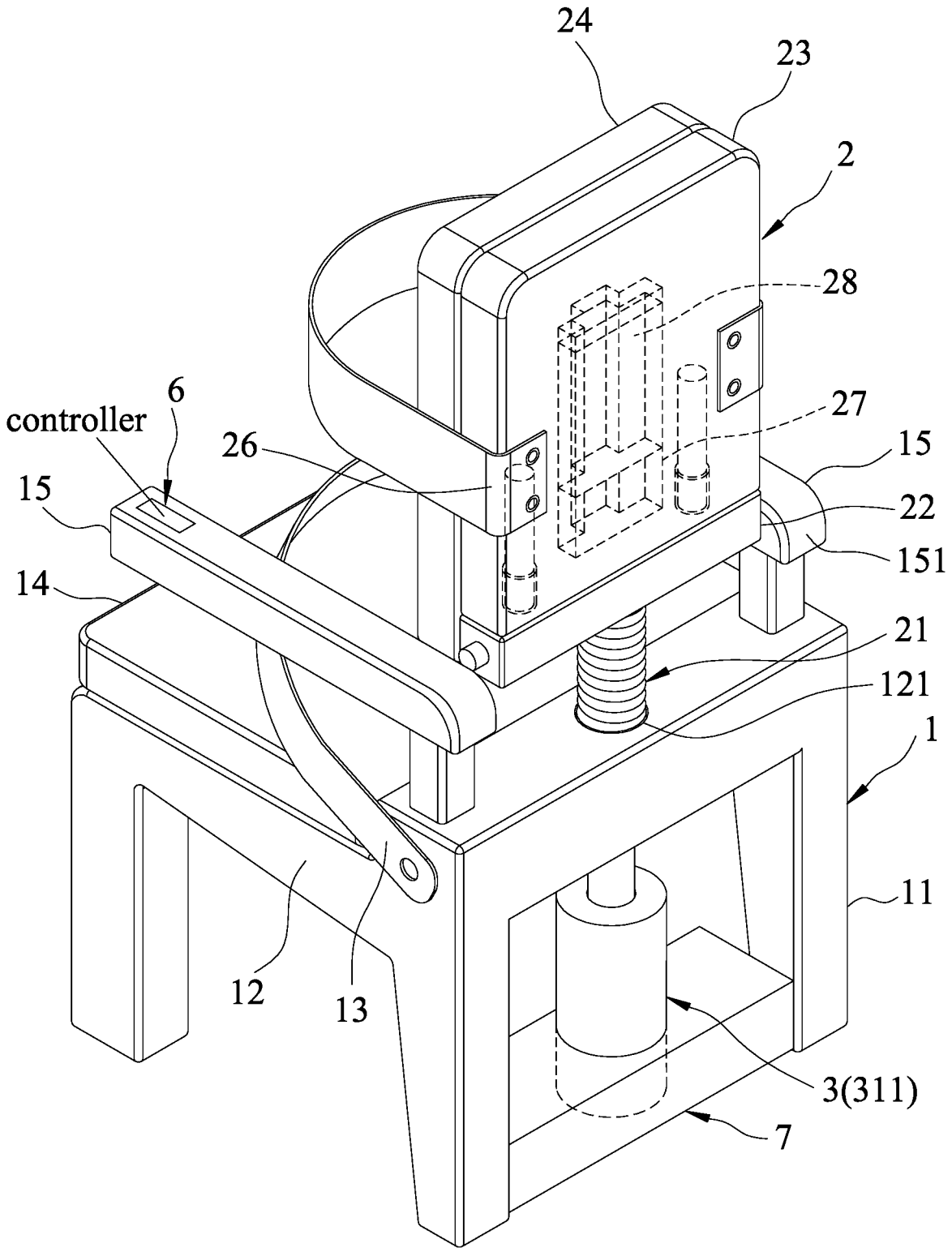
FIG. 1 is a perspective view illustrating a sitting type spinal traction and disc massage apparatus of an embodiment according to the disclosure.
Figure 2:
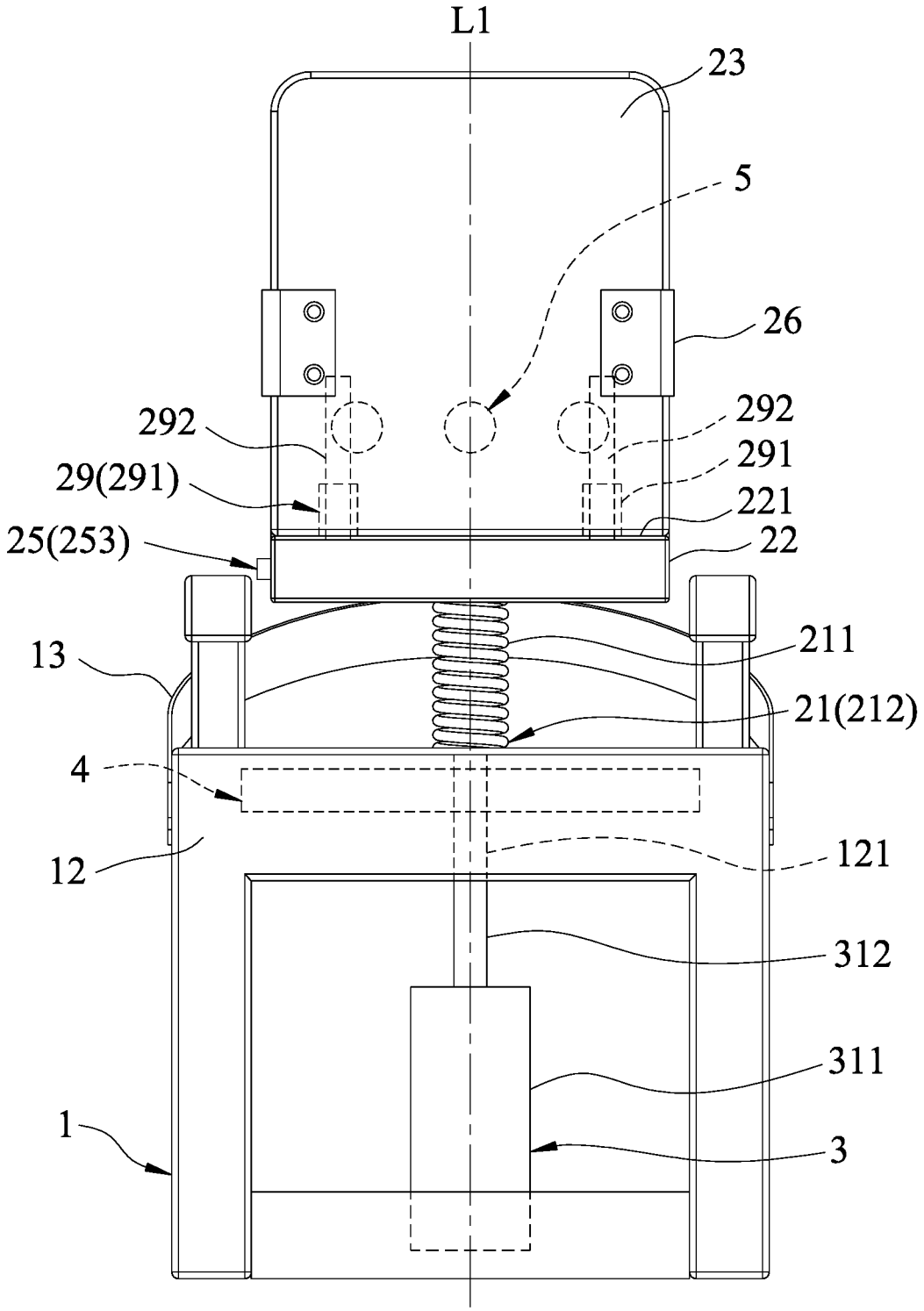
FIG. 2 is a rear view of the embodiment, illustrating a moving backrest board moved proximally to a fixing base.
Figure 3:
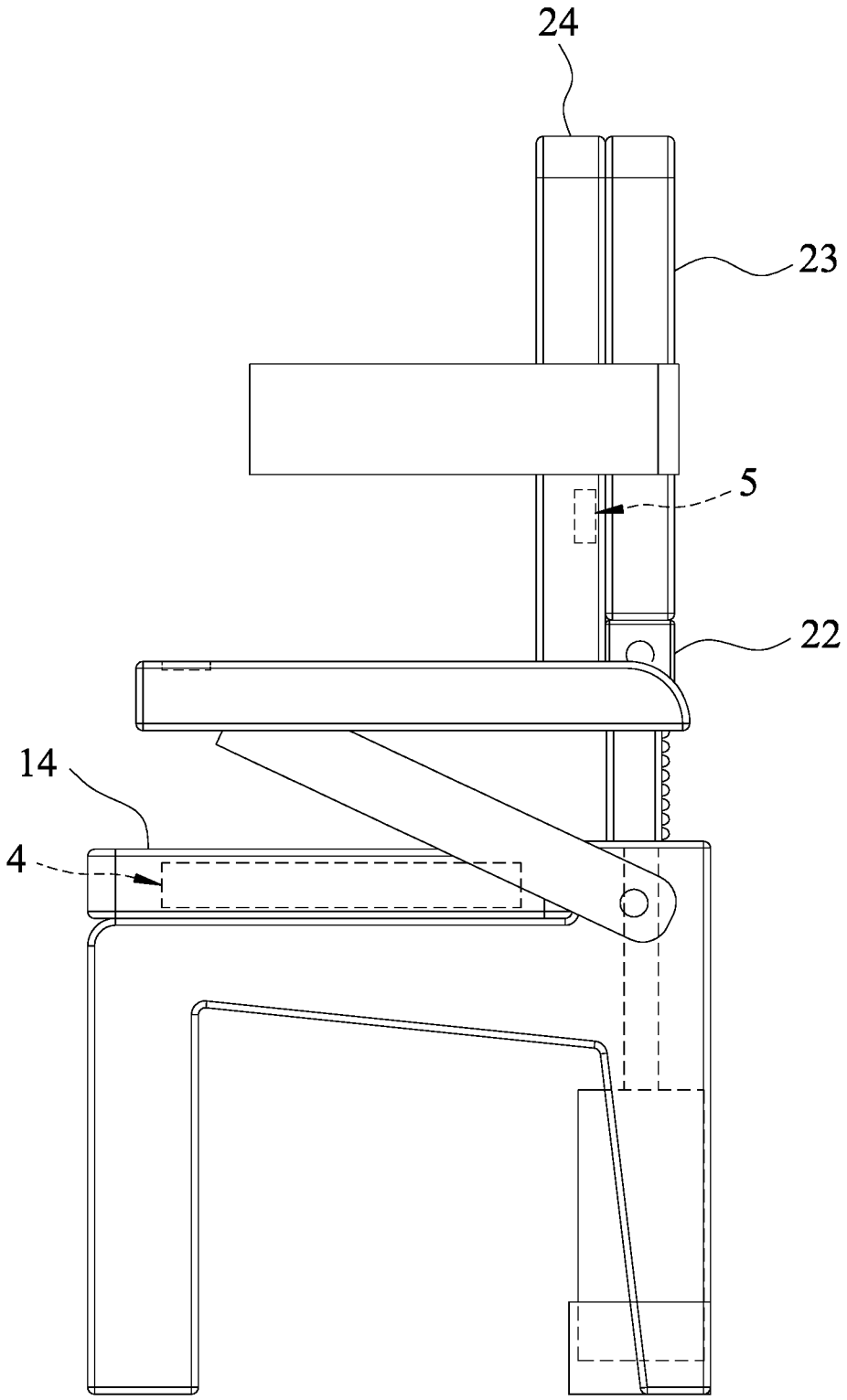
FIG. 3 is a side view of the embodiment of FIG. 2.

Referring to FIGS. 1 to 3, a sitting type spinal traction and disc massage apparatus of an embodiment according to the disclosure is shown and includes a chair unit 1, a traction unit 2, a lifting unit 3, a vibrating unit 4, a heating assembly 5, and a controller 6.

The chair unit 1 includes a leg assembly 11, a seat member 12, a seat pad 14, a fixing member 13, and two armrests 15. The seat member 12 is disposed atop the leg assembly 11, and has a through hole 121 extending through the seat member 12 in a top-bottom direction (L1). The seat pad 14 is disposed atop the seat member 12. The fixing member 13 straddles the seat member 12 and the seat pad 14 and is connected to left and right sides of the seat member 12 to fix hips of a user to the seat member 12. The two armrests 15 are respectively disposed on the left and right sides of the seat member 12. Each of the armrests 15 is movable upwardly and downwardly relative to the seat member 12, and has a rear end with an arcuate top surface 151 that is curved downwardly. In this embodiment, the fixing member 13 is an adjustable elastic belt. The armrests 15 are driven by a motor (not shown) to move upwardly and downwardly along rails (not shown). The structure and form of the fixing member 13 and the armrests 15 are well known to persons skilled in the art and thus will not be described in detail here.

The traction unit 2 is connected to the chair unit 1. In this embodiment, the traction unit 2 includes a support member 21, a fixing base 22, a moving backrest board 23, a backrest pad 24, a positioning set 25, and a restricting member 26. The support member 21 is disposed on and extends upwardly from a rear end of the seat member 12. The fixing base 22 is disposed on a top end 211 of the support member 21. The moving backrest board 23 is disposed above the fixing base 22 and the rear end of the seat member 12, and is movable upwardly and downwardly relative to the seat member 12. The backrest pad 24 is disposed on a front side of the moving backrest board 23 and is movable upwardly and downwardly relative to the moving backrest board 23. The positioning set 25 is connected to the moving backrest board 23 and the fixing base 22. The restricting member 26 straddles the moving backrest board 23 and is connected to lift and right sides of the moving backrest board 23. The backrest board 23 and the backrest pad 24 support the user's back. One of the backrest pad 24 and the moving backrest board 23 has a sliding recess 27. The other one of the backrest pad 24 and the moving backrest board 23 has a sliding block 28 slidable upwardly and downwardly within the sliding recess 27. In this embodiment, the sliding recess 27 is disposed on the front side of the moving backrest board 23. The sliding block 28 is disposed on a rear side of the backrest pad 24. The restricting member 26 is configured to extend across the user's chest beneath the user's armpits and to fix the user's upper body to the moving backrest board 23. The restricting member 26 is, but not limited hereto, an adjustable elastic belt or a fastener made from a hard material. The moving backrest board 23 is movable toward and away from the fixing base 22 along the top-bottom direction (L1). The positioning set 25 is capable of positioning the moving backrest board 23 relative to a top surface 221 of the fixing base 22.

Figure 4:
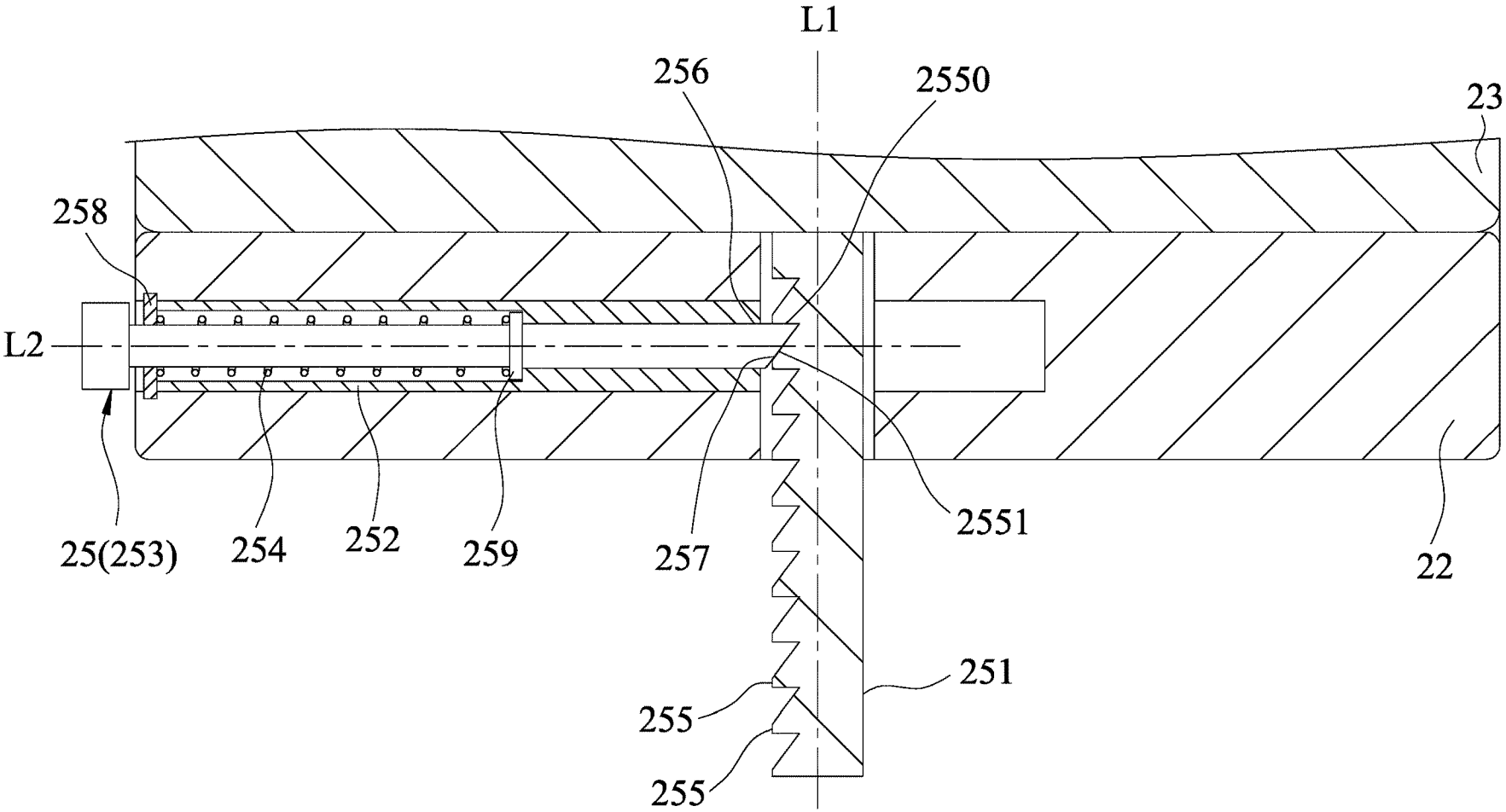
FIG. 4 is an enlarged fragmentary sectional view of the embodiment, illustrating the moving backrest board, the fixing base, and a latch member engaging with unidirectional ratchet teeth on a positioning rod.
Figure 5:
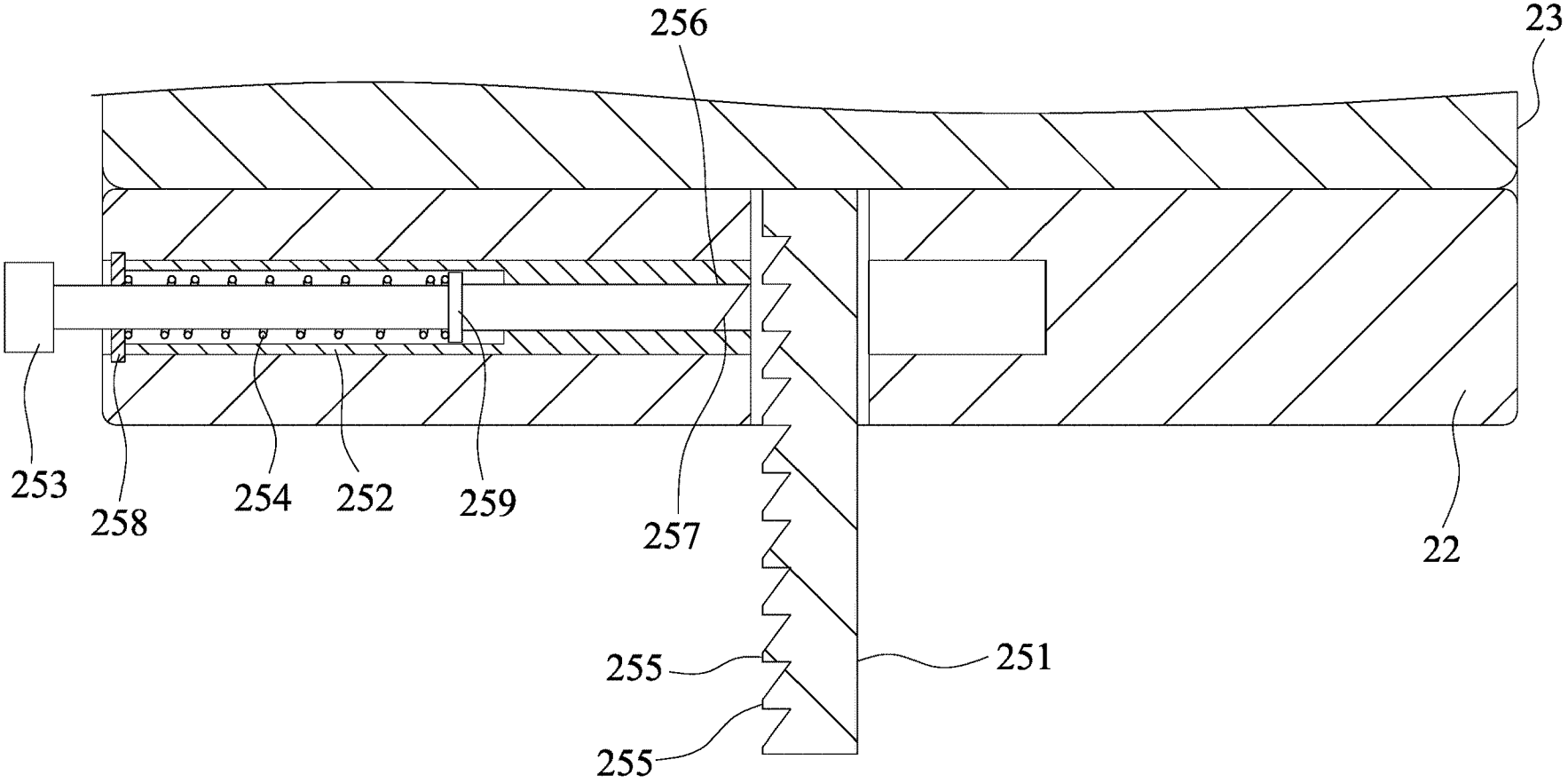
FIG. 5 is a view similar to FIG. 4, but illustrating the latch member disengaging from the unidirectional ratchet teeth.
Figure 6:
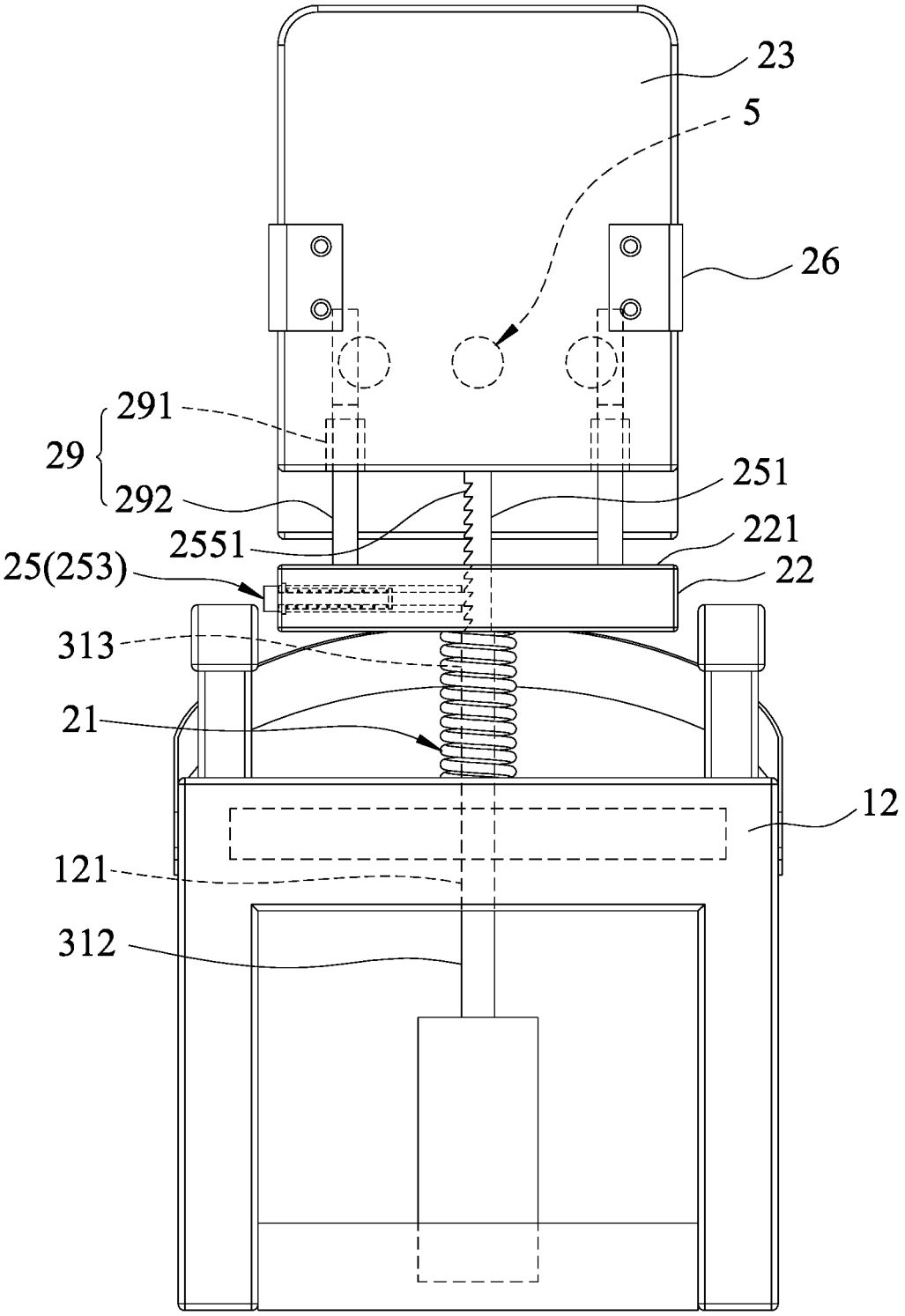
FIG. 6 is a view similar to FIG. 2, but illustrating the moving backrest board moved away from the fixing base.

Referring to FIGS. 4 to 6, the positioning set 25 has a positioning rod 251, a guide seat 252, a latch member 253, and a resilient member 254. The positioning rod 251 is connected to a bottom end of the moving backrest board 23 and extends movably through the fixing base 22 along the top-bottom direction (L1). The guide seat 252 is fixed to the fixing base 22 and extends along a sideward direction (L2) transverse to the top-bottom direction (L1). The latch member 253 is inserted into the guide seat 252 along the sideward direction (L2). The resilient member 254 is disposed within the guide seat 252 and connects the latch member 253 to the guide seat 252. In addition, the positioning rod 251 has a plurality of unidirectional ratchet teeth 255 facing the latch member 253 and aligned along the top-bottom direction (L1). The resilient member 254 urges the latch member 253 to move along the sideward direction (L2) for engagement with the unidirectional ratchet teeth 255. The latch member 253 has a non-inclined upper engagement face 256 and an inclined lower engagement face 257 connected to one end of the non-inclined upper engagement face 256. The latch member 253 is operable to move against the resilient member 254 to disengage from the unidirectional ratchet teeth 255. Each of the unidirectional ratchet teeth 255 has a non-inclined lower abutment face 2550, and an inclined upper face 2551 connected to one of the non-inclined lower abutment face 2550 and slidable over the inclined lower engagement face 257. When the latch member 253 engages with the unidirectional ratchet teeth 255 (see FIG. 4), the non-inclined upper engagement face 256 abuts against the non-inclined lower abutment face 2550 of one of the the unidirectional ratchet teeth 255 situated immediately above the latch member 253 to prevent downward movement of the positioning rod 251. However, the positioning rod 251 is allowed to be pushed upwardly relative to the latch member 253 (see FIG. 6). When the latch member 253 is operated to disengage from the unidirectional ratchet teeth 255 (see FIG. 5), the positioning rod 251 is allowed to move downwardly by gravity.

In this embodiment, a C-type ring 258 is fixed to the guide seat 252 and is disposed around the latch member 253 at a point away from the positioning rod 251 along the sideward direction (L2). The latch member 253 further has a stop portion 259 situated between the C-type ring 258 and the positioning rod 251. The resilient member 254 is a helical spring that has two opposite ends respectively abutting the C-type ring 258 and the stop portion 259. The latch member 253 further has an outermost end exposed from the guide seat 252 and disposed distally from the positioning rod 251. The user can pull the outermost end of the latch member 253 to move the latch member 253 away from the positioning rod 251 and to disengage the latch member 253 from the unidirectional ratchet teeth 255.

Referring back to FIG. 2, the support member 21 has a bottom end 212 opposite to the top end 211 of the support member 21 and is connected to the seat member 12. In addition, the support member 21 is a helical spring having a relatively high spring stiffness that can maintain a distance between the fixing base 22 and the seat member 12. An example of the helical spring is one that is similar to a suspension spring of a vehicle shock absorber.

The traction unit 2 further includes a guiding set 29 disposed between the fixing base 22 and the moving backrest board 23 to guide movement of the moving backrest board 23 in a unrotational manner toward and away from the fixing base 22 along the top-bottom direction (L1). The guiding set 29 includes two guiding seats 291 disposed within the moving backrest board 23, and two guiding rods 292 disposed on the top surface 221 of the fixing base 22. The guiding rods 292 respectively extend through the guiding seats 291 along the top-bottom direction (L1). In addition, the guiding rods 292 and the guiding seats 291 are movable relative to each other along the top-bottom direction (L1). In other embodiments, the guiding seats 291 can be disposed on the fixing base 22, and the guiding rods 292 can be disposed on the moving backrest board 23. The number of the guiding seats 291 and the guiding rods 292 can be one or more than two.

Figure 10:
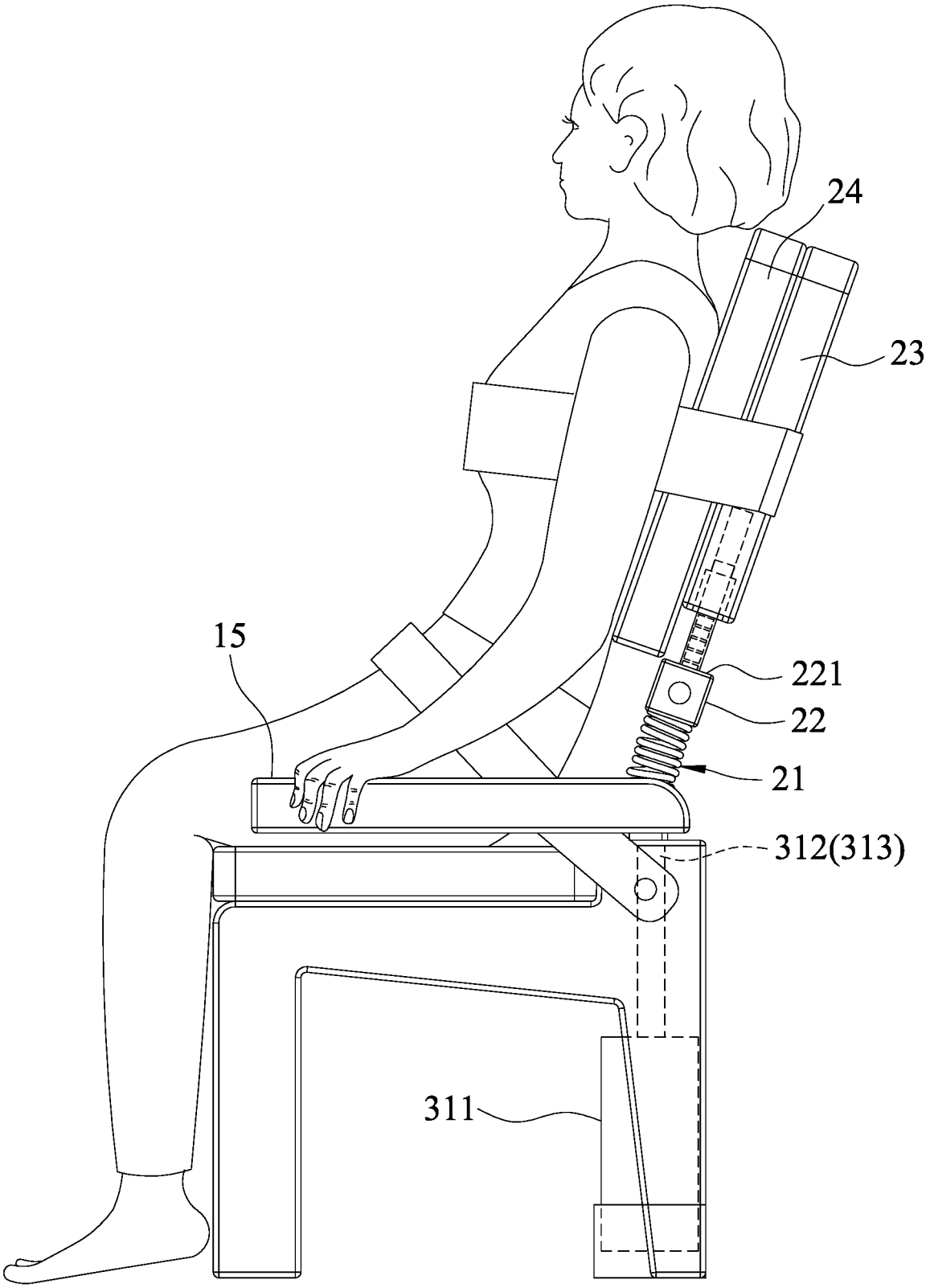
FIG. 10 is a side view illustrating the moving backrest board moving away from the fixing base to pull a user's upper body when the user leans the back rearward.

Referring to FIG. 10 in combination with FIG. 6, the lifting unit 3 is disposed below the moving backrest board 23 to move the moving backrest board 23 upwardly from the seat member 12 to stretch the user's spine. The lifting unit 3 is able to separably abut a bottom end of the positioning rod 251 to push upward the positioning rod 251 along the top-bottom direction (L1). When the lifting unit 3 extends upward, it lifts the moving backrest board 23 to move away from the fixing base 22. When the lifting unit 3 retracts downward, it separates from the traction unit 2. When the lifting unit 3 separates from the traction unit 2, the top end 211 of the support member 21 is swayable and rotatable relative to the bottom end 212 of the support member 21 to allow the user to do waist exercises while the user undergoes traction.

In this embodiment, the lifting unit 3 is a jack assembly that includes a pressure cylinder 311 disposed below the seat member 12, and a piston rod 312 extending outwardly and upwardly from the pressure cylinder 311 and passing through the through hole 121. The lifting unit 3 is switchable between lifting and releasing states. When the lifting unit 3 is in the lifting state (see FIG. 6), a top end 313 of the piston rod 312 extends upwardly and outwardly from the through hole 121 through the support member 21 to connect the bottom end of the positioning rod 251 and pushes upward the positioning rod 251 to move the moving backrest board 23 away from the fixing base 22 along the top-bottom direction (L1). When the lifting unit 3 is in the releasing state (see FIG. 10), the top end 313 of the piston rod 312 retracts into the through hole 121 and disconnects from the positioning rod 251. The lifting unit 3 may be, but not limited hereto, an electric-hydraulic jack connected to a motor (not shown) and an oil tank (not shown), or a pneumatic jack, or a nut and screw rod assembly driven by a motor (not shown). As shown in FIG. 1, a mounting base 7 is fixed to a bottom end of the leg assembly 11. While the pressure cylinder 311 is fixed to the mounting base 7 in this embodiment, the fixing of the pressure cylinder 311 is not limited thereto. The pressure cylinder 311 may be fixed to the seat member 12 in other embodiments.

Figure 11:
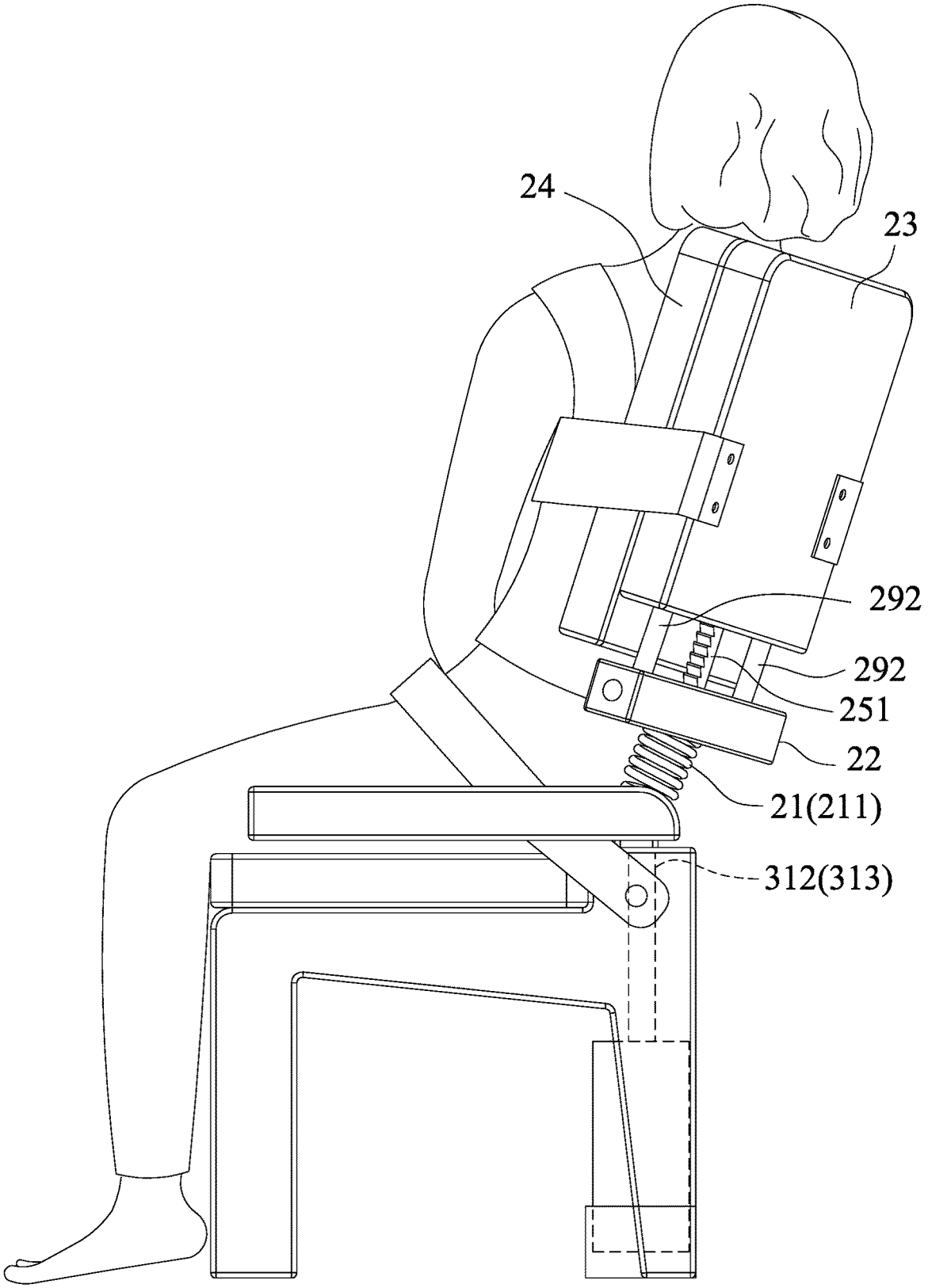
FIG. 11 is a view similar to FIG. 10, but illustrating the user turning rightward.

Referring back to FIG. 6, when the lifting unit 3 pushes upward the positioning rod 251, the inclined upper abutment faces 2551 of the unidirectional ratchet teeth 255 slide over the inclined lower engagement face 257 of the latch member 253 to allow the unidirectional ratchet teeth 255 to move upwardly. As shown in FIGS. 4 and 10, when the lifting unit 3 retracts downward and away from the positioning rod 251, the non-inclined lower abutment face 2550 of one of the unidirectional ratchet teeth 255 abuts the non-inclined upper engagement face 256 of the latch member 253 to prevent the positioning rod 251 from moving downward, thereby immobilizing the moving backrest board 23. As shown in FIGS. 10 and 11, when the top end 313 of the piston rod 312 disconnects from the positioning rod 251 and retracts into the through hole 121, the top end 211 of the support member 21 is swayable in front-rear and left-right directions relative to the bottom end 212 of the support member 21.

Moreover, the sitting type spinal traction and disc massage apparatus further includes a pressure sensor (not shown) to detect a pressure produced when the lifting unit 3 pushes upward the moving backrest board 23. The lifting unit 3 stops pushing the moving backrest board 23 when the pressure exceeds a pre-set pressure.

Referring back to FIG. 3, the vibrating unit 4 is disposed within and vibrates the seat pad 14. In this embodiment, the vibrating unit includes, but not limited to, a motor (not shown) and a plurality of massage cams (not shown) connected to and driven by the motor to vibrate the seat pad 14.

Referring back to FIGS. 2 and 3, the heating assembly 5 is disposed within the backrest pad 24 to heat the user's upper body.

Referring back to FIG. 1, the controller 6 is electrically connected to the lifting unit 3, the vibrating unit 4, the heating assembly 5, and the motor (not shown) driving movement of the armrests 15 to control operation of the armrests 15, the lifting unit 3, the vibrating unit 4, and the heating assembly 5.

Figure 7:
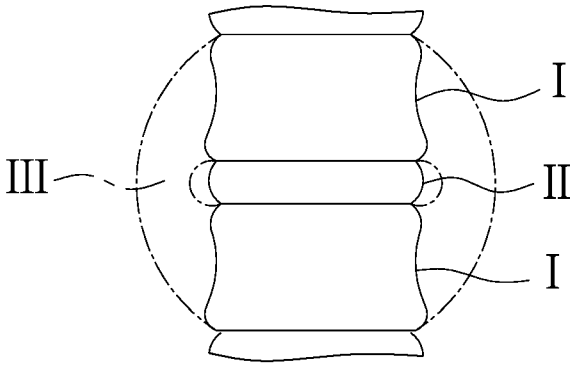
FIG. 7 is a fragmentary view illustrating an intervertebral disc compressed between vertebrae.
Figure 8:
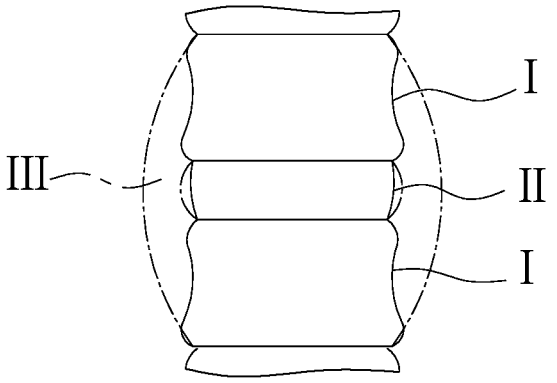
FIG. 8 is a view similar to FIG. 7, but illustrating the vertebrae being pulled apart from each other.
Figure 9:
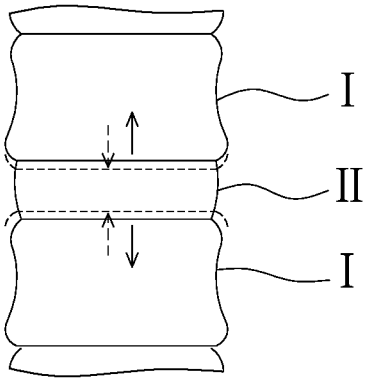
FIG. 9 is a view similar to FIG. 8, but illustrating the vertebrae and intervertebral disc being vibrated and massaged.

In use, the user sits on the seat pad 14, and the fixing member 13 fixes the hips and thighs of the user to the seat member 12. The restricting member 26 fixes the user's upper body to the backrest pad 24 and the moving backrest board 23 while the moving backrest board 23 is at the lowest position proximate to the fixing base 22 and the latch member 253 engages with the unidirectional ratchet teeth 255. When the controller 6 actuates the lifting unit 3 to move to the lifting state, the lifting unit 3 extends and pushes upward the positioning rod 251 to move the moving backrest board 23 upwardly relative to the fixing base 22 (see FIG. 6). Meanwhile, the user's upper body is pulled upwardly by the restricting member 26 and the moving backrest board 23. Because the user's hips are fixed to the seat member 12, pulling the user's upper body stretches the user's lumbar spine to decompress the user's intervertebral discs. FIGS. 7 to 9 illustrate two vertebral segments (I), an intervertebral disc (II) between the vertebral segments (I), and a spinal muscle (III) adjacent the vertebral segments (I) and the intervertebral disc (II) FIG. 7 illustrates that the user's spine has not been stretched by the moving backrest board 23. The vertebral segments (I) compress the intervertebral disc (II) to protrude sideward, and the spinal muscle (III) contracts. As shown in FIG. 8, when the moving backrest board 23 moves to stretch the user's spine, the vertebral segments (I) are moved away from each other to decompress the intervertebral disc (II), and the spinal muscle (III) is relaxed.

When the moving backrest board 23 is lifted to a lifting position that the user can tolerate, the user activates the vibrating unit 4 through the controller 6 to vibrate the seat pad 14 upward and downward so that the vertebral segments pulled apart from each other move in a reciprocating manner toward and away from each other to massage the intervertebral discs. This may remove waste products of the spine and facilitate nutrient absorption in the intervertebral discs. As shown in FIG. 9, when the user's spine stretches and the vibration unit 4 is activated, the vertebral segments (I) move toward and away from each other in the reciprocating manner (as shown by arrows), and the intervertebral disc (II) is massaged. Because the vertebral segments (I) are pulled apart from each other beforehand by the moving backrest board 23, the space between the vertebral segments (I) can be appropriately maintained when the vibrating unit 4 is used. Therefore, the invertebral disc (II) may be alternately compressed and decompressed between the vertebral segments (I) without experiencing excessive compression. During vibration of the vibrating unit 4, the backrest pad 24 abuts the the user's back. By virtue of the sliding recess 27 and the sliding block 28, the backrest pad 24 is movable upwardly and downwardly relative to the moving backrest board 23 to reduce friction between the backrest pad 24 and the user's back. As shown in FIGS. 10 and 11, when the moving backrest board 23 is at the lifting position, the user may use the controller 6 to actuate the lifting unit 3 to the releasing state and to move the armrests 15 downwardly. When the piston rod 312 retracts into the through hole 121 and disconnects from the positioning rod 251, the positioning rod 251 is positioned by the latch member 253 to maintain the moving backrest board 23 at the lifted position. Therefore, under the condition that the vertebral segments of the user are pulled apart from each other, the user's upper body is movable in the front-rear and left-right directions and rotatable against the resilient force of the support member 21 for rehabilitation. After rehabilitation, the latch member 253 is pulled by the user and disengages from the unidirectional ratchet teeth 255 so that the the moving backrest board 23 moves together with the positioning rod 251 to the lowest position proximate to the fixing base 22.

The advantages of the sitting type spinal traction and disc massage apparatus can be summarized as follows:

1. By virtue of the traction unit 2 connected to the chair unit 1 to reduce occupying space, the sitting type spinal traction and disc massage apparatus is beneficial for use in a hospital/clinic and at home.

2. By virtue of the traction unit 2 in combination with the lifting unit 3 and the vibrating unit 4, the user's spine may be stretched and at the same time intervertebral discs may be massaged.

3. When the lifting unit 3 separates from the traction unit 2, the top end 211 of the support member 21 is moveable in the front-rear and left-right directions and rotatable relative to the bottom end 212 of the support member 21 to allow the user to do waist exercises simultaneously with lumbar spine stretching.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A spinal traction and disc massage apparatus, comprising:

a chair unit including a leg assembly, a seat member disposed atop said leg assembly, a seat pad disposed atop said seat member, and a fixing member straddling said seat member and said seat pad and connected to left and right sides of said seat member, said fixing member being configured to fix hips of a user to said seat member;

a traction unit connected to said chair unit and including a moving backrest board disposed above a rear end of said seat member and movable upwardly and downwardly relative to said seat member, and a restricting member straddling said moving backrest board and connected to left and right sides of said moving backrest board, said restricting member being configured to fix the user's upper body to said moving backrest board;

a lifting unit disposed below said moving backrest board to move said moving backrest board upwardly from said seat member to stretch the user's spine; and a vibrating unit disposed within and vibrating said seat pad;

wherein said traction unit further includes a support member disposed on and extending upwardly from the rear end of said seat member, a fixing base disposed on a top end of said support member and below said moving backrest board, a positioning set connected to said moving backrest board and said fixing base, said moving backrest board being movable toward and away from said fixing base along a top-bottom direction, said positioning set being capable of positioning said moving backrest board relative to said fixing base;

wherein said support member has a bottom end opposite to said top end of said support member and connected to said seat member;

wherein, when said lifting unit extends upward, said lifting unit lifts said moving backrest board to move away from said fixing base;

wherein, when said lifting unit retracts downward, said lifting unit separates from said traction unit; and wherein, when said lifting unit separates from said traction unit, said top end of said support member is swayable and rotatable relative to said bottom end of said support member to allow the user to do waist exercises while the user undergoes traction.

2. The spinal traction and disc massage apparatus as claimed in claim 1, wherein said support member is a helical spring.

3. The spinal traction and disc massage apparatus as claimed in claim 1, wherein:

said positioning set has a positioning rod connected to a bottom end of said moving backrest board and extending movably through said fixing base along the top-bottom direction, a guide seat fixed to said fixing base and extending along a sideward direction transverse to the top-bottom direction, a latch member inserted into said guide seat, and a resilient member disposed within said guide seat and connecting said latch member to said guide seat;

said positioning rod has a plurality of unidirectional ratchet teeth facing said latch member and aligned along the top-bottom direction, said resilient member urging said latch member to move along the sideward direction for engagement with said unidirectional ratchet teeth, said latch member being operable to move against said resilient member to disengage from said unidirectional ratchet teeth;

said lifting unit is able to separably abut a bottom end of said positioning rod to push upward said positioning rod along the top-bottom direction;

said latch member has a non-inclined upper engagement face and an inclined lower engagement face connected to one end of said non-inclined upper engagement face, each of said unidirectional ratchet teeth having a non-inclined lower abutment face and an inclined upper face connected to one of said non-inclined lower abutment face;

when said lifting unit pushes upward said positioning rod, said inclined upper abutment faces of said unidirectional ratchet teeth slide over said inclined lower engagement face of said latch member to allow said unidirectional ratchet teeth to move upwardly;

when said lifting unit retracts downward and away from said positioning rod, said non-inclined lower abutment face of one of said unidirectional ratchet teeth abuts said non-inclined upper engagement face of said latch member to prevent said positioning rod from moving downward, thereby immobilizing said moving backrest board; and when said latch member is operated to disengage from said unidirectional ratchet teeth, said positioning rod is allowed to move downwardly by gravity.

4. The spinal traction and disc massage apparatus as claimed in claim 1, wherein:

said seat member has a through hole extending through said seat member in the top-bottom direction;

said lifting unit is a jack assembly that includes a pressure cylinder disposed below said seat member, and a piston rod extending outwardly and upwardly from said pressure cylinder and passing through said through hole, said lifting unit being switchable between a lifting state and a releasing state;

when said lifting unit is in the lifting state, a top end of said piston rod extends upwardly and outwardly from said through hole to connect said traction unit and drives said moving backrest board to move away from said fixing base; and when said lifting unit is in the releasing state, said top end of said piston rod retracts into said through hole and disconnects from said traction unit.

5. The spinal traction and disc massage apparatus as claimed in claim 1, wherein said chair unit further includes two armrests respectively disposed on the left and right sides of said seat member, each of said armrests being movable upwardly and downwardly relative to said seat member, and each of said armrests having a rear end with an arcuate top surface that is curved downwardly.

6. The spinal traction and disc massage apparatus as claimed in claim 1, wherein said traction unit further includes a backrest pad disposed on a front side of said moving backrest board and movable upwardly and downwardly relative to said moving backrest board, one of said backrest pad and said moving backrest board having a sliding recess, the other one of said backrest pad and said moving backrest board having a sliding block slidable upwardly and downwardly within said sliding recess.

7. The spinal traction and disc massage apparatus as claimed in claim 6, further comprising a heating assembly disposed within said backrest pad.

8. The spinal traction and disc massage apparatus as claimed in claim 1, wherein said traction unit further includes a guiding set disposed between said fixing base and said moving backrest board to guide movement of said moving backrest board toward and away from said fixing base along the top-bottom direction, said guiding set including at least one guiding seat disposed on one of said fixing base and said moving backrest board, and at least one guiding rod disposed on the other one of said fixing base and said moving backrest board, said at least one guiding rod extending through said guiding seat along the top-bottom direction, said at least one guiding rod and said at least one guiding seat being movable relative to each other along the top-bottom direction.

* * * * *